US005349932A

United States Patent [19]

Boverie et al.

[11] Patent Number: 5,349,932

[45] Date of Patent: Sep. 27, 1994

[54] METHOD AND DEVICE FOR CONTROL OF THE RICHNESS OF THE AIR/FUEL FEED MIXTURE OF AN INTERNAL COMBUSTION ENGINE

[75] Inventors: Serge Boverie, Plaisance-du-Touch; Pierre Bidan, Toulouse, both of France

[73] Assignee: Siemens Aktiengesellschaft, Munich, Fed. Rep. of Germany

[21] Appl. No.: 927,310

[22] PCT Filed: Mar. 1, 1991

[86] PCT No.: PCT/EP91/00387

§ 371 Date: Sep. 23, 1992

§ 102(e) Date: Sep. 23, 1992

[87] PCT Pub. No.: WO91/13249

PCT Pub. Date: May 9, 1991

[30] Foreign Application Priority Data

Mar. 2, 1990 [FR] France ..... 90 02633

[51] Int. Cl.[5] ..... F02D 41/24

[52] U.S. Cl. ..... 123/399

[58] Field of Search ..... 123/350, 399, 492, 493

[56] References Cited

U.S. PATENT DOCUMENTS

| | | | |
|---|---|---|---|
| 4,760,825 | 8/1988 | Morita | 123/340 |
| 4,763,264 | 8/1988 | Okuno et al. | 123/399 |
| 4,987,888 | 1/1991 | Funabashi et al. | 123/492 |

FOREIGN PATENT DOCUMENTS 0115868 8/1984 European Pat. Off. .

OTHER PUBLICATIONS

Patent Abstracts of Japan, vol. 9, No. 209 (M-407) (1932) 27 Aug. 1985, & JP, A, 6069248 (Suzuki) 19 Apr. 1985.

Patent Abstracts of Japan, vol. 13, No. 77 (M-801) (3425) 22 Feb. 1989, & JP, A, 63277833 (Mitsubishi) 15 Nov. 1988

Patent Abstracts of Japan, vol. 3, No. 101 (M-70), 25 Aug. 1979, & JP, A, 5477803 (Toshiba) 21 Jun. 1979.

Patent Abstracts of Japan, vol. 5, No. 61 (M-65) (733), 24 Apr. 1981, & JP, A, 5614834 (Nippon Denso) 13 Feb. 1981.

Patent Abstracts of Japan, vol. 5, No. 68 (M-67) (740), 8 May 1981, & JP, A, 5620730 (Asian) 26 Feb. 1981.

*Primary Examiner*—Andrew M. Dolinar

*Attorney, Agent, or Firm*—Herbert L. Lerner; Laurence A. Greenberg

[57] ABSTRACT

A setpoint air charge ($R_c$) is calculated from an indicated setpoint ($\theta$) of the position of an accelerator pedal, a reference charge value ($R_r$) is extracted from a behavioural model of the engine (15) activated in real time by the setpoint charge ($R_c$), an air charge value of the engine ($R_m$) is measured, and, from the difference ($R_c$-$R_m$), the opening ($\phi$) of an air-intake throttle valve of the engine (15) is controlled in such a way that the air charge ($R_m$) of this engine closely follows that of the reference charge ($R_r$) calculated by the behavioural model. Application to the control of an engine propelling a motor vehicle.

15 Claims, 3 Drawing Sheets

Figure 1:
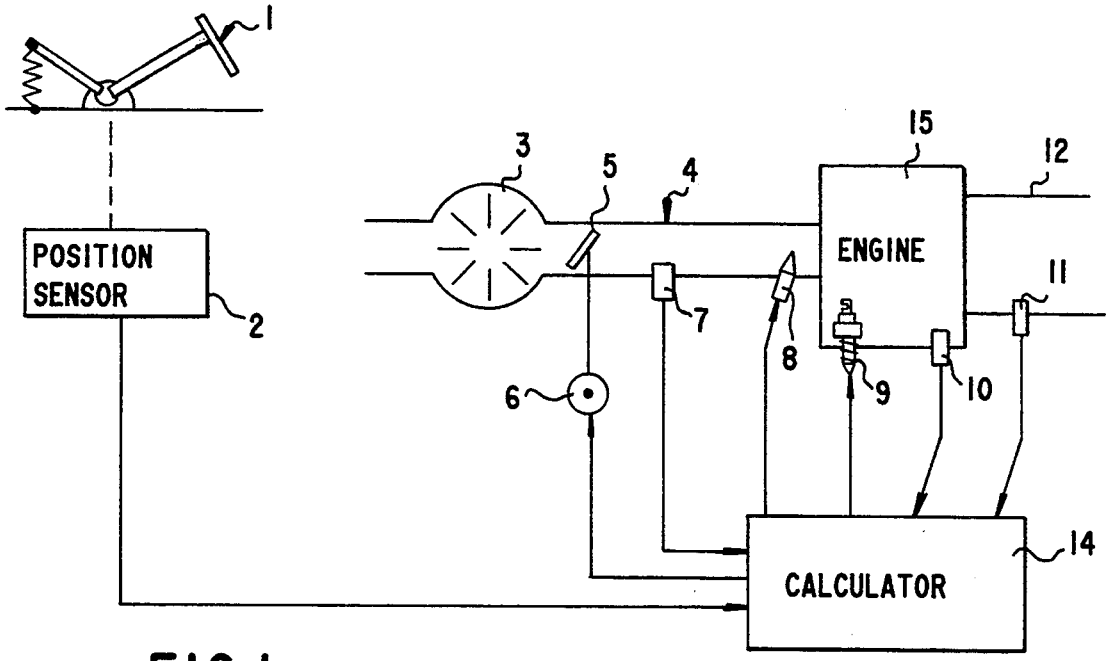

METHOD AND DEVICE FOR CONTROL OF THE RICHNESS OF THE AIR/FUEL FEED MIXTURE OF AN INTERNAL COMBUSTION ENGINE

The present invention relates to a method and a device for control of the richness of an air/fuel feed mixture of an internal combustion engine and, more particularly, to such a method and such a device calling upon a behavioural model of the engine.

A method and a device for predictive control of the injection of petrol into such an engine are known from the document EP-A-115,868. This method calls upon two mathematical models. A first mathematical model permits definition of the quantity of air actually taken up by each cylinder of the engine as a function of an input variable characteristic of the measurement of the quantity of air entering the intake manifold of the engine (angle of opening of the air-intake throttle valve, pressure sensor, etc.) and of experimental parameters characteristic of the air-intake circuit of the engine, obtained by bench measurements produced on a prototype of the engine. This model also permits, in a sampled system, prediction of the quantities of air which will be taken up with an advance of one sampling period, by relying on an assumption of linear variation of this quantity of air. The second mathematical model used serves to define the quantity of petrol to be actually injected into the cylinder as a function of the theoretical quantities suitable for maintaining a specified richness, and calculated for the previous instants and the following instant on the basis of the quantities of air taken up, established by the previous model.

It should be remarked that the two models used are independent of one another and, in particular, that the method of the abovementioned document is free of supervision on the quantity of air entering the engine, a parameter which is thus "sustained" by the system.

The abovementioned document also describes a variant permitting the system to be adapted to various operating cases for which a single model of each characteristic "air" or "petrol" is not sufficient. Sensors are then added (temperature, angle of the throttle valve etc.) in order to define operating zones (hot, cold, full load etc.) and a complementary device switches, in accordance with a specified chart, the description parameters of the models in order to adapt the reaction of the system to the operating conditions. Thus, for example, a sudden variation the angle of the throttle valve may cause the selection of models defining a higher (acceleration) or lower (deceleration) richness.

The predictive calculations applied in the method of the abovementioned document may however by flawed during sudden accelerations or decelerations controlled by the driver, by virtue of the absence of locking of the claculated parameters to actual measurements, as is inherent in any predictive system. The drift which is then noted is reflected through an error in the richness of the mixture, an error damaging as much from the point of view of pollution by the exhaust gases, as from the point of view of driving comfort.

The purpose of the present invention is therefore to provide a method, and to produce a device, for control of the richness of an air/fuel feed mixture of an internal combustion engine, which does not exhibit these disadvantages of the predictive systems.

The purpose of the present invention is also to provide such a method and such a device in which the quantity air taken up by the engine is a controlled parameter.

These purposes of the invention, as well as others which will emerge in the remainder of the present description, are accomplished with a method for control of the richness of the air/fuel feed mixture of an internal combustion engine, in accordance with which: a setpoint air charge ($R_c$) is calculated from an indicated setpoint (Theta) of position of an accelerator pedal; a reference air charge ($R_r$) is extracted from a behavioural model (212) of the engine activated in real time by the setpoint air charge ($R_c$), wherein in the behavioural model the change of the reference air charge (dRr/dt) is related to the setpoint and the reference air charges ($R_c$, $R_r$); an air charge value of the engine ($R_m$) is measured, and, from the difference ($R_c$- $R_m$) of the setpoint air charge ($R_c$) and the measured air charge value ($R_m$), the opening ($\phi$) of an air-intake throttle valve of the engine is controlled in such a way that the change in the air charge ($R_m$) of the engine closely follows than of the reference charge ($R_r$) calculated by the behavioural model.

Thus the method according to the invention permits perfect supervision of the masses of air and of petrol entering the engine, in such a way as to constrain the latter to follow the behaviour defined by the model. The latter being known perfectly, in contrast to the behaviour of the engine left to itself, it becomes possible to optimise the response of the engine as a function of this or that objective: minimal pollution, optimum mechanical response of the engine under required transient acceleration conditions, etc. It is also possible to increase the efficiency of the engine whilst yet minimising the quantity of pollutant emitted per unit mass of burnt fuel.

According to the invention, in the static regime, the quantity of petrol to be injected into the mixture is calculated from the measured charge ($R_m$) and from a specified setpoint richness ($r_c$) .

In the transient regime, an estimate of the mass of petrol to be injected over a specified time horizon ($\tau$) is produced, from an estimate of the air charge of the engine over the same horizon, obtained with the aid of the behavioural model of the engine, and the quantity of petrol to be injected is adjusted as a function of this estimate and of a specified setpoint richness ($r_c$).

According to a characteristic of the method according to the invention, a saturation function is applied to the rate of change of the estimated charge.

According to yet another characteristic of the method according to the invention, a specified control law is applied to the angle ($\theta$) of position of the accelerator pedal, in order to deduce therefrom the setpoint charge ($R_c$). A dynamic filtering is applied to the setpoint charge in order to introduce, for example, a pure delay.

A signal ($R_c$-$R_r$) previously shaped with the aid of a saturation function is applied to the behavioural model. The measured air charge ($R_m$) is subtracted from the reference charge ($R_r$) delivered by the behavioural model, and the difference ($R_r$- $R_m$) is shaped in order to form a signal ($\Delta R$).

According to the invention, moreover, a signal ($R_c$-$R_m$) is formed, this signal is shaped with the aid of a saturation function, the shaped signal is added to the signal ($\Delta R$), and a method of linearisation by return of state is applied to this sum in order to extract therefrom a signal for control of the opening ($\phi$) of the air-intake throttle valve of the engine.

Figure 2:
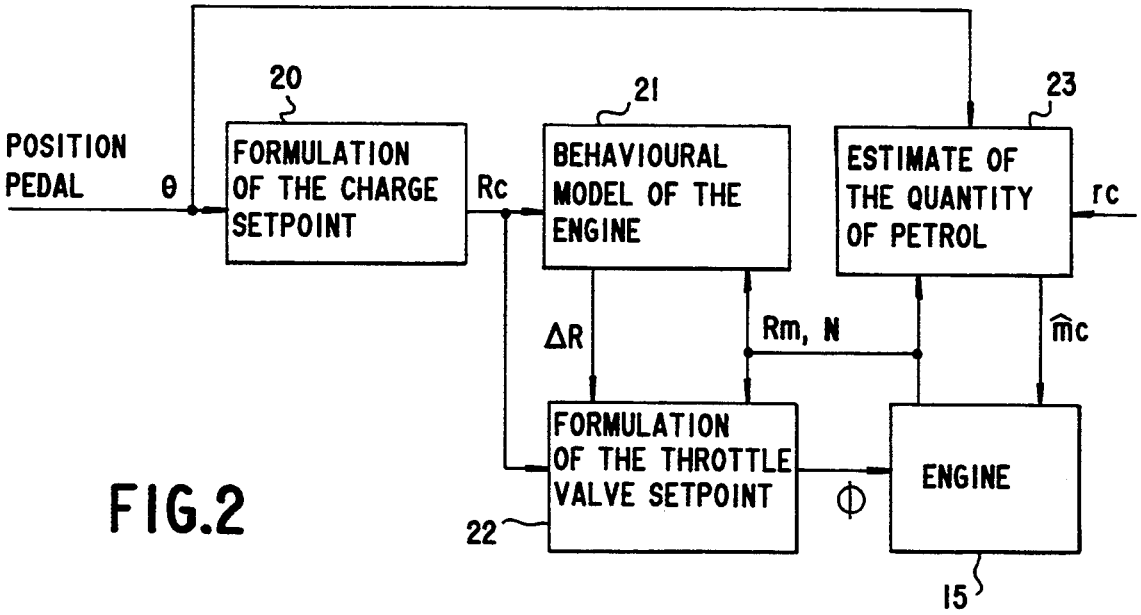
Figure 3:
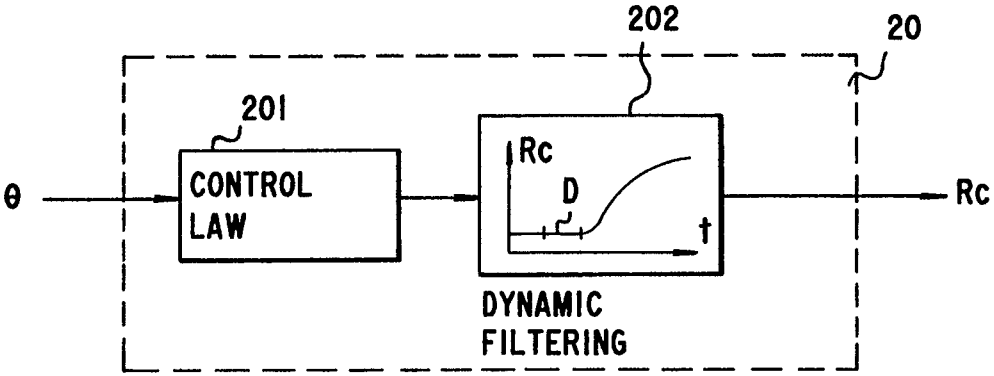
Figure 4:
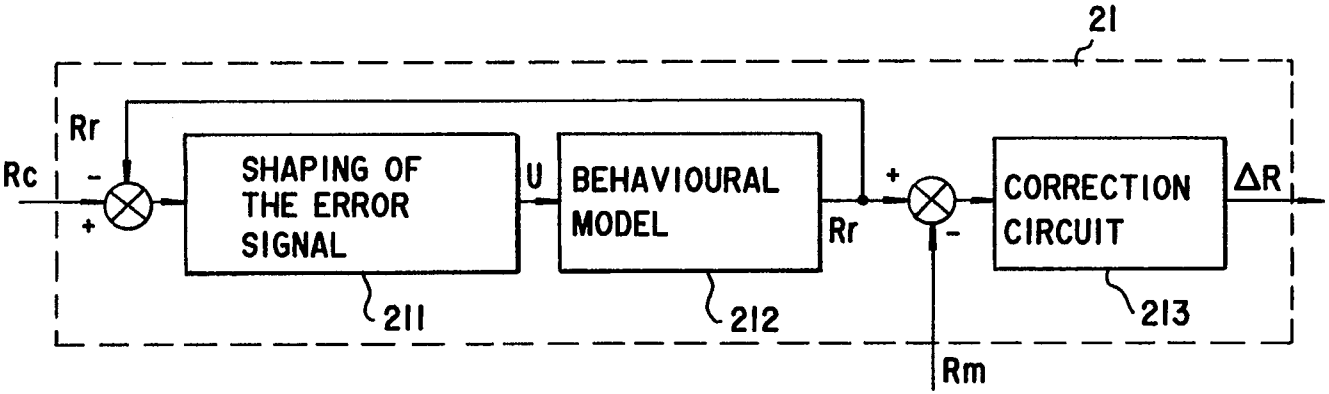
Figure 5:
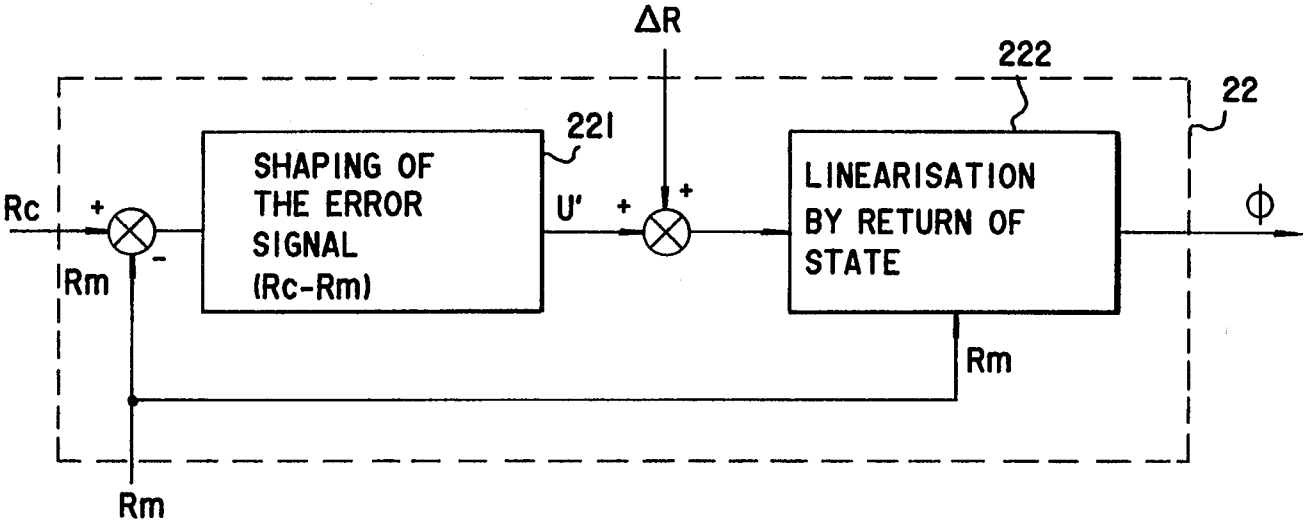
Figure 6:
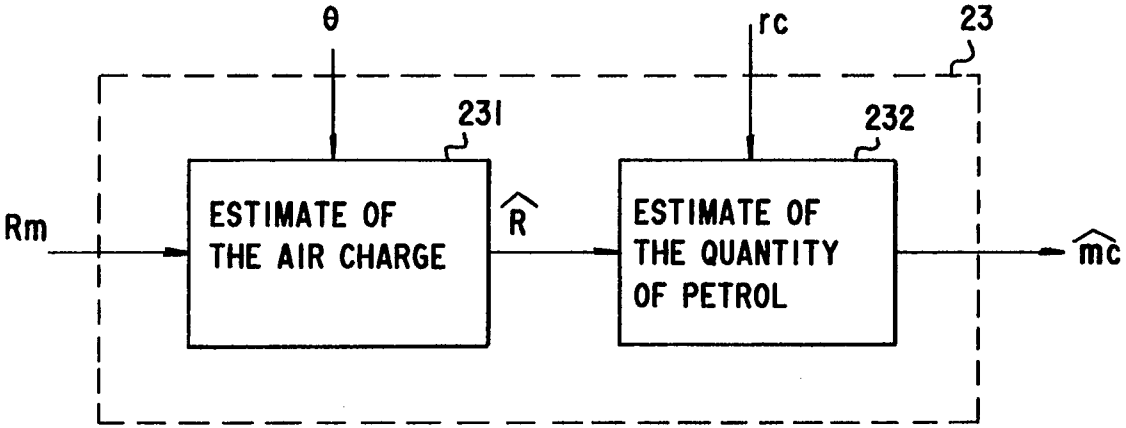

For the application of the method according to the invention, a device is provided with means for calculating a setpoint air charge ($R_c$) from an indicated setpoint (Theta) of position of an accelerator pedal; and with means for extracting a reference air charge ($R_r$) from a behavioural model (212) of the engine, which is activated in real time by the setpoint air charge ($R_c$), wherein in the behavioural model the change of the reference air charge (dRr/dt) is related to the setpoint and the reference air charges ($R_c$, $R_r$); and with means for measuring an air charge value of the engine ($R_m$) and, with means for calculating the difference ($R_c$- $R_m$) of the setpoint air charge ($R_c$) and the measured air charge value ($R_m$), and with means for controlling the opening ($\phi$) of an air-intake throttle valve of the engine in such a way that the change in the measured air charge value ($R_m$) of the engine closely follows that of the reference air charge ($R_r$) calculated by the behavioural model. In the attached drawing, given merely by way of example:

FIG. 1 schematically represents an engine linked to a calculator and sensors and actuators necessary for applying the present invention, FIG. 2 is an operating diagram of the control device according to the invention, FIG. 3 is an operating diagram of a block for formulating an air charge setpoint forming part of the device of FIG. 2, FIG. 4 is an operating diagramm of a block of the device of FIG. 2, comprising a behavioural model of the engine, FIG. 5 is an operating diagram of a block for formulating the setpoint for opening of the throttle valve of the engine, forming part of the device of FIG. 2, and FIG. 6 is an operating diagram of a block for estimating the quantity of petrol to be injected into the engine, forming part of the device of FIG. 2.

The control method according to the invention is more particularly intended to be applied with an internal combustion engine propelling a motor vehicle. Reference is made to FIG. 1 of the attached drawing in order to describe the essential units which must be linked to such an engine 15 in order to enable this application.

An accelerator pedal 1 permits the driver of the vehicle to adjust the available torque on the output shaft of the engine 15, as a function of the driving conditions. In a conventional engine, the accelerator pedal 1 is mechanically coupled to a throttle valve 5 for adjusting the intake of air, placed in an intake pipe 4.

According to the invention, and for purposes which will be described in detail further on, the accelerator pedal 1 is decoupled from the throttle valve 5. A sensor 2 of position of the pedal 1 delivers a signal representative of the position of the pedal to a calculator 14. It is known that the engine torque is directly related to the air charge of the engine. By air "charge" or more correctly "volumetric efficiency" is conventionally understood the dimensionless magnitude defined by the ratio between the mass of fresh air trapped by a cylinder during an intake and the mass of air which it could theoretically draw in between the upper and lower dead centres under normal conditions of temperature and pressure.

Therefore the signal transmitted by the sensor 2 to the calculator is representative of an air charge setpoint value $R_c$, such as is fixed by the driver. This setpoint is processed by the calculator (as will be seen later) in accordance with the control method according to the invention in such a way as to produce a signal for control of an actuator such as an electric motor 6 for adjusting the opening of the throttle valve 5. The calculator 14 conventionally receives other signals from sensors such as an intake pressure sensor 7 placed in the intake pipe 4, downstream of the throttle valve 5 (itself placed downstream of an air filter 3), an oxygen probe 11 placed in the exhaust pipe 12 of the engine, and a sensor 10 of speed of the engine, with variable reluctance for example. With the aid of the signals thus received the calculator formulates, apart from the signals for control of the throttle valve 5, signals for control of actuators such as a fuel injector 8 placed in the intake pipe and of spark plugs 9 each linked to a cylinder of the engine 15.

It will be noted that the intake pressure sensor 7 could be replaced by a mass flow meter, for example, for measuring the air charge of the engine, as is well known. The sensor 2 may be of the potentiometric type. The motor 6 may of the stepped or d.c. type. It permits precise adjustment of the position of the throttle valve 5.

The calculator 14 is equipped in order to ensure the acquisition and the digitising of the various parameters mentioned above and in order to formulate controls of the various actuators, by virtue of the strategies according to the invention, which are installed therein. These strategies permit, as will be seen further on, the estimation, the prediction and the supervision of the "engine" parameters and, more particularly, the supervision of the masses of air and of fuel induced into the engine. More particularly, the strategies developed permit, from a setpoint given by the driver through the accelerator pedal, and from behavioural constraints of the engine in the transient phases (accelerations/ decelerations for example), perfect supervision of the masses of air and of petrol entering the engine.

These strategies apply a behavioural model of the engine describing the change in engine parameters such as the air charge. By way of example, the behavioural model may be chosen in such a way that the rate of change of the engine torque (proportional to the air charge) is all the larger the larger is the discrepancy between the setpoint emanating from the driver and the production this setpoint. This model is used implicitly in order to constrain the engine to a behaviour as close as possible to that chosen as reference.

The model is activated in real time by an air charge setpoint $R_c$ formulated by the device according to the invention, from the position of the accelerator pedal 1 fixed by the driver. The model permits the estimation, in the transient phases, of the quantity of petrol to be injected. It plays a corrective role in regard to the strategies for control of position of the throttle valve by permitting the setting of the said control in such a way that the behaviour of the engine 15 is perfectly in accord with that of the behavioural model chosen as reference.

Reference is made to FIG. 2 of the attached drawing where the operating diagram of the control method according to the invention has been represented. Practically, this method is applied by virtue of appropriate software installed in the calculator 14 of the assembly represented in FIG. 1. The operating diagram comprises several modules 20 to 23 which will be detailed further on. From a setpoint of position $\theta$ of the accelerator pedal 1 given by the driver, measured by the position sensor 2 and digitised, a module 20 formulates an air charge setpoint $R_c$ of the engine. This setpoint $R_c$ guides a module 21 comprising a behavioural model of the engine, which delivers in real time, as a function of $R_c$ and of a measured air charge $R_m$ of the engine, a reference charge $R_r$. The module 21 also delivers a signal $\Delta R$ homogenous with the error between the measured charge $R_m$ and the reference charge $R_r$.

A module 23 serves to calculate an estimated quantity of petrol $\hat{m}_c$ to be delivered to the engine. In the phases of constant operation of this engine, the quantity of fuel to be injected is estimated by the module 23 from the setpoint $\phi$ indicated by the driver and from the measurement $R_m$ of the charge of the engine. In the transient phases, as will be seen later, the module 23 produces an estimate of the mass of petrol to be injected over a specified time horizon, in order to compensate for delay problems related to diverse physical phenomena intervening in the engine.

The engine speed N and the measured charge $R_m$ are obtained with the aid of signals delivered by the speed sensor 10 and the intake pressure sensor 7 respectively. These variables, in combination with the variables $R_c$ and $\Delta R$ formulated by the modules 20 and 21, are processed in a module 22 dedicated to formulating the setpoint for opening $\Phi$ of the throttle valve 5. This setpoint is a function of the constraints imposed on the assembly composed of the module 22 and of the engine 15 since the behaviour of this assembly is determined in such a way that it be as close as possible to that of an engine defined by the behavioural model 21. Any discrepancy between the behaviour of the assembly constituted by the module 22 and the engine 15 and that defined by the model 21 is corrected by the term $\Delta R$.

Reference will now be made more particularly to the module 20 and to FIG. 3 which represents this module in more detail. As has been seen earlier the function of this module is, from the setpoint $\theta$ fixed by the driver, to formulate a dynamic setpoint value $R_c$ of the air charge ratio of the engine. As appears in FIG. 3, the signal $\theta$ is processed in a block 201 defining a control law and the signal formulated in this block is next processed by a dynamic filtering block 202.

The control law converts the datum $\theta$ delivered by the position sensor 2 into a setpoint value homogeneous with the air charge of the engine. This setpoint is consequently substantially proportional to an engine torque. The processing of the datum $\theta$ by the control law is defined as a function of ergonomic criteria taking into account the wishes of drivers as regards the reactions of the vehicle. A control whose sensitivity grows with the depression of the accelerator pedal 1 can for example be imagined. This control law thus ensures overall a conversion similar to that performed by the "mechanical spirals" existing in conventional engine systems.

The dynamic filtering block 202 provided in the module 20 may for example introduce a simple pure delay D into the control. This delay permits, in particular, compensation for the calculation, acquisition and injection times, as well as the lags related to the dynamics of the flow of petrol. It should be imperceptible to the driver.

In extreme situations involving, for example, the safety of the driver and of the vehicle (slipping, skidding, etc.), the intentions of the driver may be minimised or even ignored by virtue of an appropriate dynamic filtering, to the benefit of a priority control (for example supervision of the torque formulated from the speed of the wheels).

Reference is now made to FIG. 4 which represents the module 21 in more detail. In this figure it can be seen that this module essentially comprises a block 211 for shaping the error signal, a block 212 defining a behavioural model of the engine, and a block 213 constituting a correction circuit. The block 212 delivers a reference charge signal $R_r$ at its output, this output being looped to the input of the block 211 in such a way that the latter is fed by a signal $(R_c\text{-}R_r)$. An output signal U from the block 211, defined below, feeds the block 212. The output from the block 212 is combined with the signal $R_m$ in order to feed the correction circuit 213 with a signal $(R_r\text{-}R_m)$, the correction circuit delivering the signal $\Delta R$.

The behavioural model defined by the block 212, which is installed directly in the calculator, permits the fixing of the dynamics of change in the air charge of the engine.

Thus, the model continuously delivers, as a function of the setpoint $R_c$ fixed by the driver, a reference air charge $R_r$. The signal $\Delta R$ delivered by the correction circuit 213 permits real time correction of behavioural errors of the actual engine system.

The reference behavioural model of the engine may for example be described by the following system of equations:

$$dR_r/dt = K(N).U, \qquad (I)$$

where K(N) is a function of the speed N, with:

$$U = G.(R_c - R_r) \text{ or } G = const, \text{ if } U_{min} < U > U_{max} \qquad (II)$$

$$U = U_{min} \text{ if } U \leqq U_{min} \qquad (III)$$

$$U = U_{max} \text{ if } U \geqq U_{max} \qquad (IV)$$

From the first (I) and from the second (II) of the expressions given above, it follows that the rate of change of the reference air charge is all the larger the larger is the discrepancy between the setpoint air charge $R_c$ and the reference air charge $R_r$. In this case the term K(N).G fixes the time constant for change in the reference charge $R_r$. Nevertheless, as emerges from expressions (III) and (IV) given above for the function U, when the discrepancy becomes too large in absolute value, a saturation function is applied to the function U and the rate of change of the reference air charge becomes constant, fixed by the term $K(N).U_{min}$ or $K(N).U_{max}$.

The correction circuit 213 delivers a datum $\Delta R$ homogeneous with the error between the reference air charge $R_r$ and the actual air charge measured on the engine $R_m$:

$$\Delta R = f(R_r - R_m)$$

This correction circuit thus has a shaping function. To this effect a corrector circuit of the proportional-/integral (PI) type may be used.

Reference is now made to FIG. 5 where the module 22 for formulating the setpoint for opening $\Phi$ of the gas throttle valve 5 has been represented. The module 22 essentially comprises a block 221 for shaping an error signal $(R_c\text{-}R_m)$, and a block 222 for linearisation by return of state. The latter block is fed by a signal $U' + \Delta R$ constituted by the addition of the signal U' delivered by the block 221 and the signal $\Delta R$ delivered by the module 21. The air charge $R_m$ of the engine such as it may be measured from the signal provided by the intake pressure sensor 7 (see FIG. 1) subtractively feeds the input of the block 221 where it is combined with the signal $R_c$ to deliver a signal ($R_c$-$R_m$) to this block, the output U' from the block 221 being additively combined with the signal $\Delta R$ in order to feed the input of the block 222 which delivers a signal for adjusting the angle of opening of the gas throttle valve 5, a signal which controls the motor 6 for adjusting the opening of this throttle valve. The signal $R_m$ also feeds the block 222. The module 22 permits the ensuring with great accuracy of the homing of the air charge of the engine to a charge setpoint $R_c$ emanating from the driver, through an action on the angle of opening $\Phi$ on the gas throttle valve 5.

In accordance with an essential characteristic of the method according to the present invention, by acting on the opening of the gas throttle valve, the actual air charge ($R_m$) measured on the engine, is constrained to a behaviour as close as possible to the behaviour defined by the reference model, activated by the same charge setpoint $R_c$.

In accordance with another advantageous characteristic of the method according to the invention, in order to accomplish this objective, a method of linearisation by "return of state" is used, applied by the block 222, a method whose principle is set out below.

The equation of change in the air charge of the engine system may be expressed through the relationship:

$$dR_m/dt=F(R_m,\Phi,M)$$

which expresses that the rate of change of the charge $dR_m/dt$ is a complex non-linear function of the angle of opening $\Phi$ of the throttle valve, of the engine speed N and of the charge $R_m$ of which it is known that the pressure prevailing in the intake manifold of the engine is a reflection.

Furthermore, the equation of change of the behavioural model cited earlier is recalled:

$$dR_r/dt=K(N).U$$

By posing as objective to be accomplished that the actual charge $R_m$ measured on the engine continuously changes like the reference charge, it follows that:

$R_m=R_r$ and $dR_m/dt=dR_r/dt$ or, by identifying the two equations given above:

$$F(R_m,\Phi,N)=K(N).U$$

By solving in $\Phi$ the equation above the expression is obtained for the control of opening of the throttle valve which permits the assembly composed of the module 22 and of the engine 15 to follow the behaviour of the model 212. The transformation carried out above is called linearisation by "return of state". It permits fixing of the dynamics of change of the air charge whilst yet compensating for the operating non-linearities of the engine.

So as to limit the dynamics of change of the air charge $R_m$, the circuit 221 for shaping the error ($R_c$-$R_m$), has the purpose of amplifying the error whilst yet containing it between a maximum value and a minimum value by the application to the output variable U' from the circuit 220, of a saturation function identical to that described earlier in connection with the output variable U from the block 211 (see FIG. 4). In this regard, it will be remarked that, if the system is perfect, $R_m=R_r$, which implies U'=U.

It must be further remarked that the process of linearisation is never perfect, for example because of errors or inaccuracies in the models used, or because certain parameters were not taken into account. If it is desired nevertheless to conserve the dynamics of the assembly constituted by the module 22 and the engine 15, as close as possible to that of the behavioural model 212, it is necessary to add at the input of the linearisation block 222, the correction term R from the module 21 incorporating the behavioural model. The input of the linearisation block 222 is then constituted by the sum of the signals from the block 221 of the module 22 and from the block 213 of the module 21.

Reference will now be made to FIG. 6 of the attached drawing in which there has been represented in more detail the module 23 for estimating the quantity of petrol forming part of the device of FIG. 2. The module 23 essentially comprises a block 231 for estimating the air charge and a block 232 for estimating the quantity of petrol. The block 231 for estimating the air charge is fed by the signals $\theta$ and $R_m$ and delivers an estimated charge signal $\hat{R}$ to the block 232 for estimating the quantity of petrol, itself fed by a signal $r_c$ representative of a setpoint richness, this block delivering a signal $\hat{m}_c$ representative of a quantity of petrol to be injected into the engine. The setpoint richness $r_c$ may be fixed by a chart, in a "pressure/speed" system for example. The module 23 then permits calculation of the quantity of petrol to be injected so that the richness setpoints of the air/fuel mixture are continuously satisfied.

In the transient phases (acceleration/deceleration for example), it is necessary to compensate for the delays. Such delays are related to the dynamics of the flow of fuel, to the time of acquisition of the necessary signals, to the well known problem of "closed valve" injection corresponding to a lead in the injection relative to the moment of intake. In order to compensate for these delays there must be available an estimate of the mass of petrol to be injected over a time horizon $\tau$ which may be greater than a half-cycle of the engine. This estimate is produced by the block 231 of the module 23. It proceeds through estimation of the air charge over the same time horizon. The instantaneous setpoint provided by the driver (the angle $\theta$ of the position of the accelerator pedal) is used in order to produce this estimate. This datum permits very rapid calculation of the estimated charge ratio $\hat{R}(t+\tau)$, without the delay D due to the dynamic filtering carried out in the module 20. It is then possible to put:

$$\hat{R}(t+\tau)=f(\hat{R}(t),\ \theta(t+\tau),\ \hat{\theta}'(t+\tau))$$

This formula expresses that the estimated charge at the instant $(t+\tau)$, namely $R(t+\tau)$, is a function of the estimated charge at the instant t, of the pedal position at the instant $(t+\tau)$ and of the estimate of the rate of change of the pedal position at the instant $(t+\tau)$ namely $\theta'(t+\tau)$.

Knowing the equation of change of the air charge of the engine given above in connection with the description of the behavioural model, it is easy to determine what will be the air charge of the engine at the instant $(t+\tau)$.

At constant speed of the engine, the measured charge $R_m$ is used directly to obtain $\hat{R}$ whatever the operating phase (transient or static). The air charge ratio then being evaluated, the quantity of petrol $\hat{m}_c$ to be injected is deduced directly from the richness setpoint $r_c$ of the air/fuel mixture such as it is fixed, for example, by a chart as was seen earlier.

It can now be seen that the present invention permits effective resolution of the problems posed by the transient regimes imposed by the driver, by virtue of a control of the air charge of the engine by means of an electric motor actuated throttle valve, Just as the injector 8 permits control of the adjusting of the petrol charge. The control method according to the invention permits regulation of the rate of change of the air charge in such a way as to enable, in particular, compensation for the pure delay due to the injectors. Action is thus taken on a determining variable as regards the accuracy of the following of the setpoint richness, possibly fixed by chart, the engine torque moreover being proportional, to within a constant, to this variable.

Thus, simultaneous control of the masses of air and of petrol admitted into the engine permits a complete regulation of the transient regimes of the engine to be ensured. By decoupling the accelerator pedal from the intake throttle valve, an intermediate dynamic delay can be introduced with a view to damping rapid transients.

The system being non linear, the invention proposes to locally apply the technique of linearisation by return of state, which has given good results experimentally.

In accordance with the invention, a reference model is thus followed, with closed loop correction of the error, the parameters of which constitute so many means of adjusting the delay between the driver's order and the response of the engine. The control of the petrol charge uses the reference model predictively from the driver's instantaneous order, with a view to partially compensating for the pure delay of the procedure for preparing the mixture.

Of course the invention is not limited to the embodiment described and represented which has been given merely by way of example.

We claim:

1. A method of controlling the richness of an air/fuel feed mixture of an internal combustion engine being controlled by an accelerator pedal and having an air intake throttle valve, which comprises:

measuring a position of the accelerator pedal;

calculating a setpoint air charge from the accelerator pedal position;

activating a behavioral model of the engine by the setpoint air charge in real time and extracting from the behavioral model a reference air charge value;

relating, in the behavioral model, a time rate of change of the reference air charge to the setpoint air charge and the reference air charge;

measuring an actual air charge value of the engine;

forming a difference between the setpoint air charge and the actual air charge value;

specifying a setpoint richness and, in steady-state operation, calculating a quantity of fuel to be injected from the actual air charge value and the setpoint richness; and controlling an opening of the air intake throttle valve in such a way that a change in the actual air charge value of the engine closely follows a change in the reference air charge extracted from the behavioral model.

2. The method according to claim 1, which comprises specifying the setpoint richness in the form of a charted setpoint richness.

3. The method according to claim 1, which comprises applying a given control law to the position of the accelerator pedal, and deducing therefrom the setpoint charge.

4. The method according to claim 3, which comprises applying dynamic filtering to the setpoint charge.

5. The method according to claim 4, which comprises introducing a pure delay with the filtering.

6. The method according to claim 1, which comprises shaping a signal by subtracting the reference air charge value from the setpoint air charge, and applying the shaped signal in the behavioral model.

7. The method according to claim 6, which comprises applying a saturation function in the shaping of the signal for ensuring a shape of the signal.

8. The method according to claim 7, which comprises subtracting the measured actual air charge from the reference air charge value, and shaping the difference for obtaining a correction signal.

9. The method according to claim 8, which comprises shaping the difference in a proportional/integral-type circuit.

10. The method according to claim 8, which comprises forming a signal by subtracting the actual air charge value from the setpoint air charge, shaping the signal with a saturation function to obtain a shaped signal, adding the shaped signal to the correction signal for forming a sum, linearizing the sum by return of state, and extracting from the linearized sum a signal for controlling an opening of the air intake throttle valve.

11. The method according to claim 9, which comprises forming a signal by subtracting the actual air charge value from the setpoint air charge, shaping the signal with a saturation function to obtain a shaped signal, adding the shaped signal to the correction signal for forming a sum, linearizing the sum by return of state, and extracting from the linearized sum a signal for controlling an opening of the air intake throttle valve.

12. A method of controlling the richness of an air/fuel feed mixture of an internal combustion engine being controlled by an accelerator pedal and having an air intake throttle valve, which comprises:

measuring a position of the accelerator pedal;

calculating a setpoint air charge from the accelerator pedal position;

activating a behavioral model of the engine by the setpoint air charge in real time and extracting from the behavioral model a reference air charge value;

relating, in the behavioral model, a time rate of change of the reference air charge to the setpoint air charge and the reference air charge;

measuring an actual air charge value of the engine;

forming a difference between the setpoint air charge and the actual air charge value; specifying a setpoint richness and, in transient operation, estimating an air charge of the engine over a given period of time with the behavioral model, estimating a mass of fuel to be injected over the given period of time from the estimated air charge, and adjusting a quantity of fuel to be injected as a function of the estimated mass of fuel and of the specified setpoint richness; and controlling an opening of the air intake throttle valve in such a way that a change in the actual air charge value of the engine closely follows a change in the reference air charge extracted from the behavioral model.

13. The method according to claim 12, which comprises calculating a time rate of change of the estimated air charge, and applying a saturation function to the time rate of change.

14. The method according to claim 12, which comprises specifying the setpoint richness in the form of a charted setpoint richness.

15. A device for controlling the richness of an air/fuel feed mixture of an internal combustion engine controlled by an accelerator pedal and having an air intake throttle valve, comprising:

means connected to an accelerator pedal for measuring a position of the accelerator pedal;

means connected to said measuring means for calculating a setpoint air charge from the measured position of the accelerator pedal; means incorporating a behavioral model of the engine and means for extracting a reference air charge from said behavioral model means;

said behavioral model means including activation means for activating said behavioral model in real time by the setpoint air charge and correlation means for correlating a time rate of change of the reference air charge with the setpoint air charge and the reference air charge;

measuring means associated with the engine for measuring an actual air charge value of the engine;

fuel control means including means for specifying a setpoint richness and for calculating a quantity of fuel to be injected from the actual air charge value and the setpoint richness; and calculating means connected to said behavioral model means and said measuring means for calculating a difference between the setpoint air charge and the actual air charge value, and throttle means operatively associated with the air intake throttle valve for controlling an opening of the air intake throttle valve in such a way that a change in the actual air charge value of the engine closely follows a change in the reference air charge calculated by said behavioral model.

* * * * *